United States Patent [19]

Zemans

[11] 4,144,089

[45] Mar. 13, 1979

[54] PROCESS FOR BLEACHING WOODEN ARTICLES

[75] Inventor: Jeffrey T. Zemans, Painesville, Ohio

[73] Assignee: True Temper Corporation, Cleveland, Ohio

[21] Appl. No.: 825,977

[22] Filed: Aug. 19, 1977

[51] Int. Cl.[2] ..... B27K 5/02

[52] U.S. Cl. ..... 134/2; 8/6.5; 134/25 A; 134/27; 134/28

[58] Field of Search ..... 134/25 A, 27, 2, 28; 8/6.5, 107

[56] References Cited

U.S. PATENT DOCUMENTS 3,370,911 2/1968 Westall ..... 8/107

FOREIGN PATENT DOCUMENTS 2054867 5/1971 France ..... 8/6.5

*Primary Examiner*—Arthur D. Kellogg
*Attorney, Agent, or Firm*—J. H. Slough

[57] ABSTRACT

Process for bleaching wooden articles by sequentially treating the articles with sodium carbonate, a hydrogen peroxide mist, and weak acid, with intermediate drying operations.

12 Claims, 1 Drawing Figure

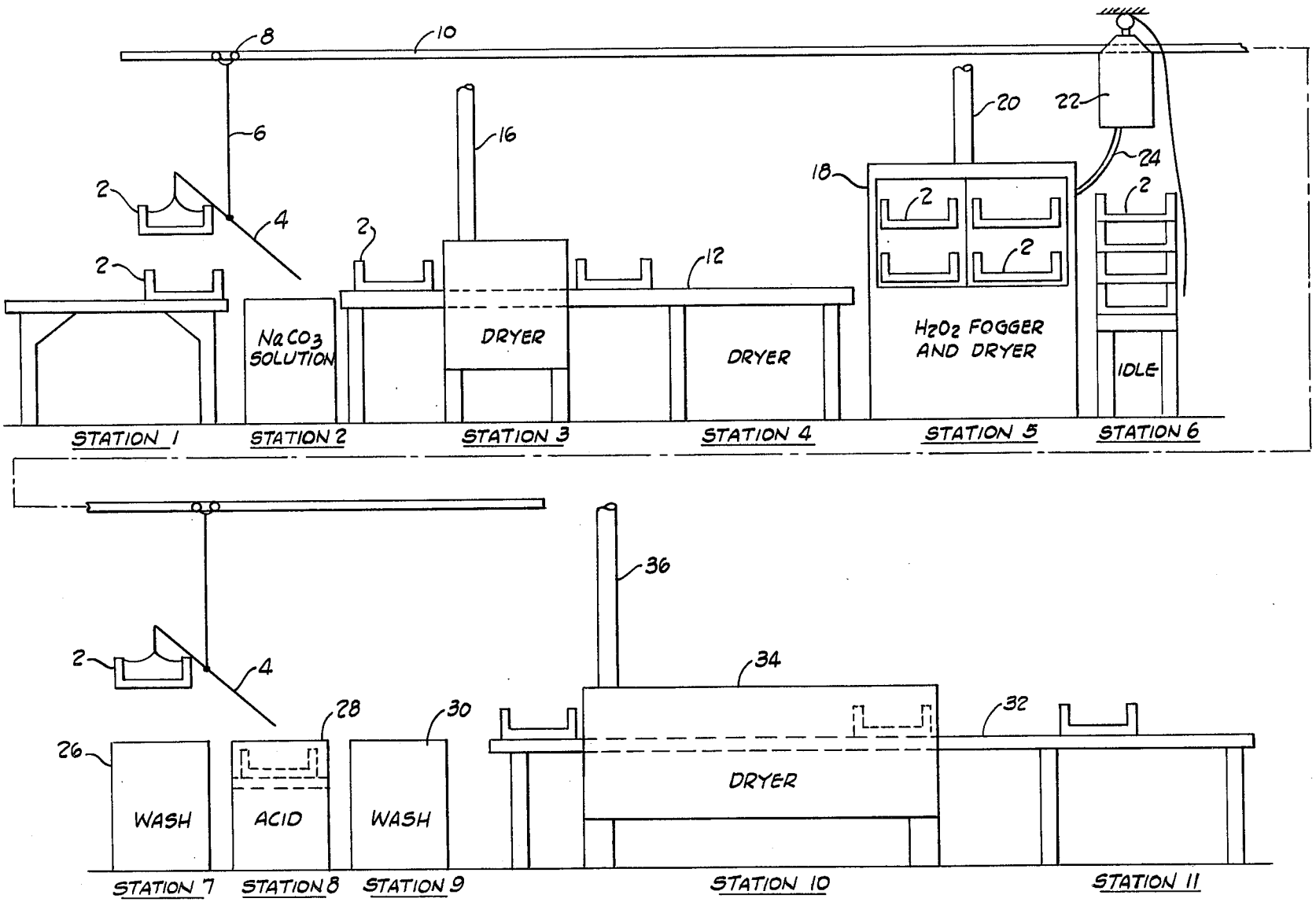
STATION 1
STATION 2
STATION 3
STATION 4
STATION 5
STATION 6
STATION 7
STATION 8
STATION 9
STATION 10
STATION 11
$Na_2CO_3$ SOLUTION
DRYER
DRYER
$H_2O_2$ FOGGER AND DRYER
IDLE
WASH
ACID
WASH
DRYER
2
4
6
8
10
12
16
18
20
22
24
26
28
30
32
34
36

PROCESS FOR BLEACHING WOODEN ARTICLES

The present invention relates to the bleaching of wooden articles, and in particular to the bleaching of colorblemished wooden workpieces to improve the appearance thereof.

Various processes for bleaching wood and materials dissimilar from wood such as textiles, are known from the prior art. It is common practice to bleach wood using alkaline solutions such as those including sodium hydroxide as the bleaching agent. U.S. Pat. No. 1,068,580 discloses a wood bleaching process wherein hydrogen peroxide is employed as a bleaching agent, and alkaline silicate is used to render the hydrogen peroxide alkaline. The bleaching action of these ingredients is accelerated by adding a solution of potassium permanganate. U.S. Pat. No. 3,922,397 relates to the bleaching of furniture through the use of hydrogen peroxide and ammonia. A process for bleaching textile fibers is disclosed in U.S. Pat. No. 3,227,655, wherein hydrogen peroxide and acetic anhydride are reacted in an aqueous medium in the presence of ammonium hydroxide. Another patent relating to the bleaching of textiles is U.S. Pat. No. 3,370,911, which discloses a yarn treating process involving the use of a bleaching solution containing hydrogen peroxide, caustic soda, sodium silicate, and a small amount of epsom salts. Similarly, U.S. Pat. No. 3,528,115 teaches the bleaching of textile fabrics by saturating the fabrics with an alkaline hydrogen peroxide bleaching solution, and contacting the fabric with acetic anhydride vapor to effect the bleaching by the peracetic acid produced by the reaction between the foregoing materials. U.S. Pat. No. 1,329,284 is directed to a method of bleaching wood wherein a solution of concentrated nitric acid is combined with potassium chlorate. In general, the bleaching of wood is accomplished by treating the wood with alkaline solutions, and the degree of bleaching depends on the alkalinity of the solution. However, a serious shortcoming of these conventional bleaching processes resides in the fact that the grain of the wood tends to rise above the body of the wood as the alkalinity and bleaching strength increases. Moreover, the wood workpieces tend to weaken and split as the workpieces absorb the bleaching solution. Also, large quantities of bleaching solution are required where the workpieces are to be immersed in the solution, causing the process to be expensive and dangerous. The application of peroxide bleaching solutions to wooden workpieces in a closed chamber utilizing a mist, fog or spray has heretofore not been used to bleach the workpieces. Thus, although the prior art does teach various bleaching processes and apparatus, there has heretofore not been available a bleaching process and associated apparatus for efficiently and effectively bleaching wooden articles such as golf club heads, tool handles, and the like.

Most wooden articles of the latter type are formed from hardwoods such as persimmon, which have a naturally light color. However, a portion of such wood pieces often have color blemishes such as dark spots which hinder subsequent finishing operations, and more significantly, detract from the cosmetic appearance of the wooden articles. It is the customary practice to discard such blemished articles. The provision of a bleaching process which would remove such blemishes without raising the grain of the wood, or weakening or splitting the wood, would be highly economically advantageous to the manufacturer of the sporting equipment, tools and the like on which such wooden articles are used.

It is an object of the present invention to provide an improved process for bleaching wooden articles such as golf club heads, tool handles, and the like.

Another object of the invention is to provide a process of the foregoing type which is adaptable for bleaching large quantities of wooden workpieces in short periods of time.

Other objects will be apparent from the description to follow and from the appended claims.

The drawing shows in schematic form an apparatus for performing the process according to the present invention.

This invention provides an effective and efficient process for bleaching wooden articles such as golf club heads, tool handles, and the like by sequentially immersing the workpieces in a weak solution of sodium carbonate ($Na_2CO_3$), treating the workpieces with a hydrogen peroxide ($H_2O_2$) fog or spray, and neutralizing the workpieces by immersing them in a weak acid solution. The process according to the invention is preferably supplemented by various washing and drying steps to improve the quality of the bleached workpiece.

The drawing shows an apparatus for performing the process of this invention. The apparatus comprises a series of work stations to which the workpieces are conveyed in sequence to effect the bleaching thereof. Station 1 is a loading station wherein workpieces, which for the purpose of this example are persimmon golf club heads, are loaded into a carrier rack 2. Rack 2 is constructed to seal the hosel in the club heads in which a shaft will ultimately be inserted, against moisture. Other wooden workpieces to be subjected to the bleaching process of the present invention which have similar recesses preferably also have the same sealed against entry of moisture. Rack 2 is suspended from one end of a support arm 4 to which is attached a cable 6, the latter in turn being secured to a pulley 8 which rides along a track 10 for transporting rack 2 to the various work stations. Rack 2 can conveniently hold 20 gold club heads.

After the rack is loaded, carrier 2 is transported to Station 2 which is a tank of 10% $Na_2CO_3$ solution. Rack 2 is transported by means of pulley 8 to a position above Station 2, and support rod 4 is pivoted to lower rack 2 into the sodium carbonate solution. The rack is immersed in the solution and the workpieces are soaked for an appropriate period such as five minutes.

After the soaking operation, rack 2 is raised from the solution and placed on an appropriate carrier such as conveyor belt 12. Rack 2 is then transported by conveyor belt 12 to Station 3, which is a hot air dryer comprising a drying chamber 14 and an exhaust pipe 16. The workpieces are kept in chamber 14 for an appropriate period such as a minimum of five minutes, and then carried by conveyor belt 12 to Station 4, an idle station. Racks 2 are accumulated at Station 4 until a predetermined number established by the number of racks to be handled at the subsequent station are disposed at the idle station.

When Station 4 is filled with the desired number of racks (four in the depicted example), the racks are transported to Station 5. In the illustrated system, it is contemplated that four racks 2 be manually placed in Station 5, although appropriate automated means can be used. Station 5 has a spraying and drying apparatus which includes a housing 18 with an exhaust pipe 20, and a hydrogen peroxide tank 22 with an appropriate inlet line 24 interconnecting tank 22 and the chamber within housing 18. When housing 18 is loaded as shown, it is run through a series of cycles involving the sequential introductions of a 50% hydrogen peroxide ($H_2O_2$) fog spray from housing 22 into housing 18, and subsequent blasts of hot air in that housing. Preferably, the fogging and drying operations are controlled automatically by appropriate timing and valve arrangements. It is contemplated that three such cycles be performed at Station 5 lasting a total of 20 minutes, with the drying temperature being in the range of 110°–130° F., and preferably at 125°–130° F. The hydrogen peroxide reacts with the sodium carbonate with which the wooden articles have been soaked, to release the oxygen which effects the bleaching operation. It is believed that the following chemical equation indicates the chemical reaction which occurs at Station 5:

$$Na_2CO_3 + H_2O_2 \quad NaHCO_3 + NaHO_2$$

The pH of the hydrogen peroxide is monitored and adjusted by the addition of alkali when necessary to be greater than 10, but less than 11.

Upon the conclusion of the steps performed at Station 5, racks 2 are removed therefrom and transported to Station 6 which is another idle station. The racks are then removed in turn from Station 6 and transported by means of pulley 8 to Station 7, a wash station. A tank 26 filled with water is located at Station 7, and preferably means are provided for agitating the water therein. Racks 2 are lowered by support rod 4 into tank 26 and immersed in the water for an appropriate soaking period such as 5 minutes to wash residual alkali from the workpieces.

Upon completion of the soaking step at Station 7, rack 2 is transported therefrom by means of pulley 8 to Station 8. The latter station has a tank 28 in which is located a weak acid solution such as 1% acetic acid ($CH_3COOH$). Rack 2, with the workpieces loaded thereon, is immersed in the acid for a predetermined period such as 5 minutes, for the purpose of reducing any alkali materials which the workpieces still may retain. The elimination of such alkali residue is important since such residue will cause a yellowing of the wood.

After the acid treatment, the racks are transported again by pulley 8 to the next work station, Station 9, at which is located a tank 30 for water and appropriate agitating means for stirring the water. The racks are lowered in turn into the water at Station 9 to remove any residual acid located on the workpieces. Racks 2 are kept at Station 9 for a predetermined period of time which, as in the preceding wash step, can be 5 minutes. Following the step at Station 9, racks 2 are carried by means of pulley 8 to a second conveyor belt 32.

Conveyor belt 32 carries racks 2 to Station 10 where there is located a hot air dryer 34. Hot air is injected into apparatus 34 for a predetermined time to dry the wooden workpieces back to their original moisture content. An appropriate drying time has been found to be 40 minutes. An exhaust pipe 36 removes the exhaust gases from dryer 34.

Conveyor 32 transports the racks of dried, bleached workpieces from Station 10 to Station 11, the latter being the final station in the illustrated system. At Station 11, it is contemplated that the workpieces be manually removed from racks 2, and that the racks be transported back to Station 1 for reloading with untreated workpieces. The finished workpieces are transported to subsequent work stations, these normally relating to the final finishing operations.

The present invention as exemplified by the process described above effectively and efficiently bleaches blemishes in such workpieces as golf club heads and tool handles. The surface treatment of the wood in the fog or mist of the bleaching solution has been found to bleach the wood with a sufficient penetration to avoid the later appearance of blemishes immediately beneath the surface of the workpiece. The workpieces have been produced with a uniform light color, and the finished workpieces are virtually undistinguishable from workpieces fabricated from unblemished wood. The finished pieces do not suffer from the raised grain and splitting defects characteristic of the prior art. The process is not only effective and efficient, but it uses readily available material, and is safe to persons associated therewith. In addition, the system described above can be operated by a single operator.

The invention has been described in detail with particular reference to a preferred embodiment thereof, but it will be understood that variations and modifications within the spirit and scope of the invention may occur to those skilled in the art to which the invention pertains.

I claim:

1. A method for bleaching a wooden article, said method comprising the steps of:

A. contacting the wooden article with a basic solution;

B. subjecting the wooden article to a bleaching agent mist including peroxide; and C. contacting the wooden article with weak acid to neutralize alkali residue on the article.

2. The invention according to claim 1 and further comprising a step of drying the article after step A and before step B.

3. The invention according to claim 1 and further comprising a step of drying the article after the commencement of step B and before step C.

4. The invention according to claim 3 wherein step B comprises repetitively contacting the wooden article with a hydrogen peroxide ($H_2O_2$) mist and drying the article.

5. The invention according to claim 1 and further comprising a step of washing the wooden article following step B and before step C.

6. The invention according to claim 5 wherein the washing step comprises immersing the wooden article in an agitated water bath.

7. The invention according to claim 1 wherein step A comprises immersing the wooden article into a weak solution of sodium carbonate ($Na_2CO_3$).

8. The invention according to claim 1 wherein step C comprises immersing the wooden article in a weak solution of acetic acid ($CH_3COOH$).

9. The invention according to claim 1 and further comprising a step of washing the wooden article in water following step C.

10. The invention according to claim 9 and further comprising the step of drying the wooden article following said washing step.

11. The invention according to claim 1 and further comprising the step of sealing recesses in the wooden article against moisture, prior to step A.

12. A method of bleaching wooden workpieces such as golf heads, tool handles and the like, said method comprising the steps of:

loading the workpieces on a carrier rack;

immersing the rack in a weak solution of sodium carbonate ($Na_2CO_3$) and soaking the workpieces in said solution;

placing the rack in a hot air dryer to dry the wooden workpieces;

placing the rack in a processing chamber and sequentially contacting the workpieces with a hydrogen peroxide ($H_2O_2$) fog spray and hot air to effect the bleaching and drying of the workpieces;

immersing the rack in a water bath to wash residual alkali from the workpieces;

immersing the rack in a weak solution of acetic acid ($CH_3COOH$) to neutralize the workpieces;

rinsing the workpieces to remove acid therefrom;

placing the rack in a hot air dryer and drying the workpieces; and unloading the workpieces from the rack.

* * * * *